United States Patent [19]

Kinshofer

[11] Patent Number: 4,654,987

[45] Date of Patent: Apr. 7, 1987

[54] GRAB BUCKET AND ACTUATING MECHANISM THEREFOR

[76] Inventor: Alfred Kinshofer, Wendelsteinstrasse 8, 8160 Miesbach, Fed. Rep. of Germany

[21] Appl. No.: 773,634

[22] Filed: Sep. 9, 1985

[51] Int. Cl.[4] ..... B66C 3/02; E02F 3/413

[52] U.S. Cl. ..... 37/186; 294/68.23; 294/88; 403/11

[58] Field of Search ..... 37/183 R, 183 A, 184–188; 294/68.23, 88; 403/11, 294, 380; 285/31

[56] References Cited

U.S. PATENT DOCUMENTS

| | | | |
|---|---|---|---|
| 2,621,428 | 12/1952 | Billings | 37/187 |
| 3,413,029 | 11/1968 | Donovan | 294/88 X |
| 3,930,738 | 1/1976 | Thuss et al. | 403/294 X |
| 4,405,167 | 9/1983 | Kinshofer | 294/68.23 |

FOREIGN PATENT DOCUMENTS

| | | | |
|---|---|---|---|
| 10182 | of 1889 | United Kingdom | 285/31 |
| 8662 | of 1907 | United Kingdom | 285/31 |

*Primary Examiner*—Clifford D. Crowder
*Attorney, Agent, or Firm*—Howard C. Miskin

[57] ABSTRACT

A two-sided grab bucket comprises a U-shaped scoop carrier and two scoops, which are provided with crosspieces, which are welded to the inside surfaces of the upper edge portions of the side walls of the scoops and are provided to the legs of the scoop carrier and two spaced apart parallel axes, actuating levers, which are welded to the crosspieces, and a transversely extending hydraulic piston-cylinder unit, which is pivoted to and connects the free ends of said levers. The crosspieces are constituted by shafts, which are provided with annular bearing surfaces on opposite sides of the longitudinal center line of the two-sided grab bucket, said annular bearing surfaces are rotatably mounted in split bearings, the legs of the scoop carrier are provided on both sides with the inner bearing shells of the split bearings, and the outer bearing shells are screw-connected to the inner bearing shells.

12 Claims, 7 Drawing Figures

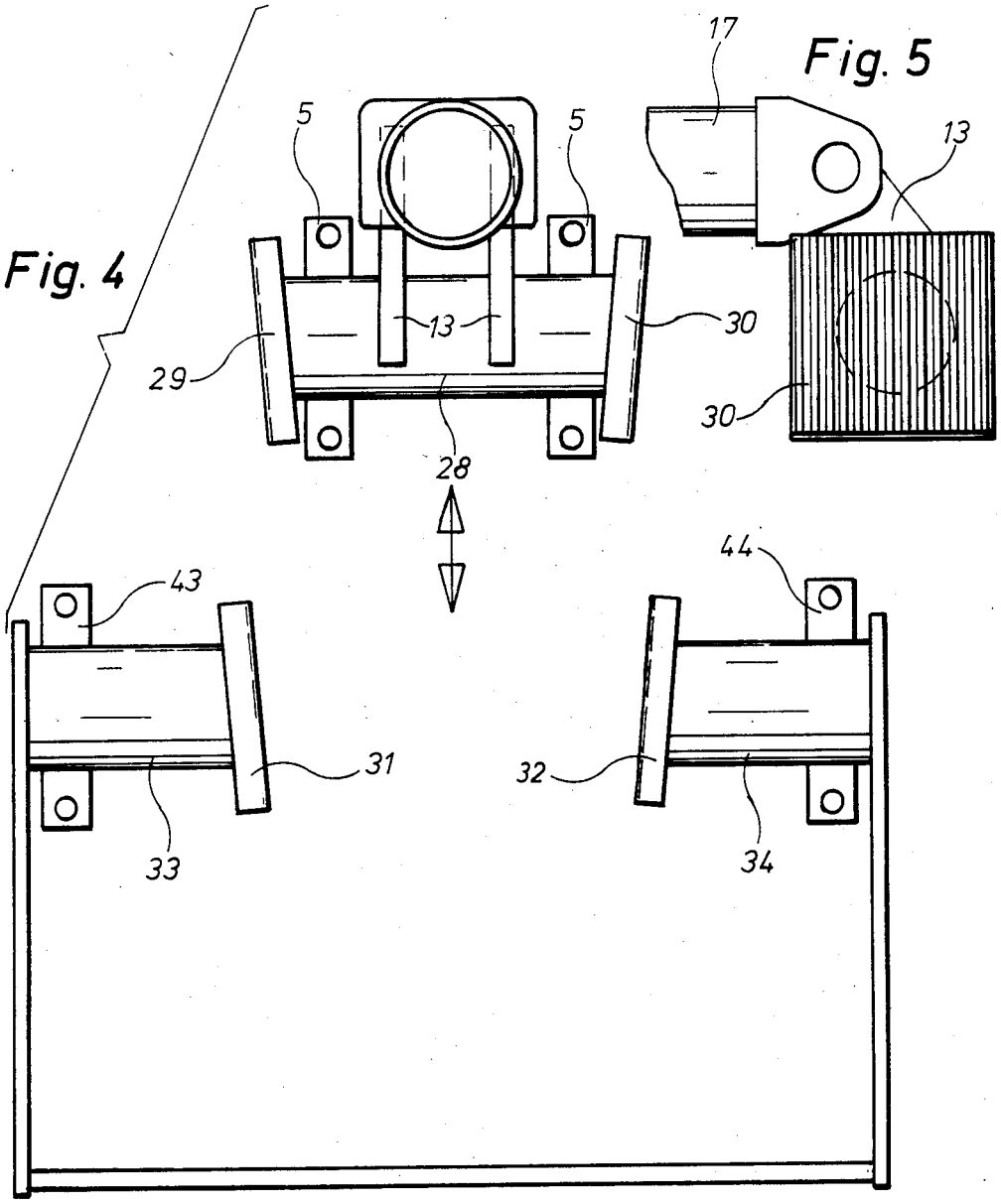
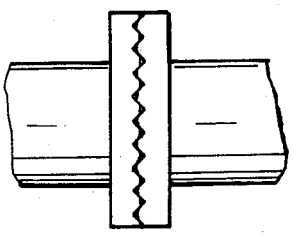
Fig. 6

GRAB BUCKET AND ACTUATING MECHANISM THEREFOR

BACKGROUND OF THE INVENTION

1. Field of the Invention

This invention comprises a two-sided grab bucket comprising a U-shaped scoop carrier and two scoops, which are provided with crosspieces, which are welded to the inside surfaces of the upper edge portions of the side walls of the scoops and are pivoted to the legs of the scoop carrier on two spaced apart parallel axes, actuating levers, which are welded to the crosspieces, and a transversely extending hydraulic piston-cylinder unit, which is pivoted to and connects the free ends of said levers.

2. Description of the Prior Art

A problem arising in connection with two-sided grab buckets resides in that each scoop will be stressed in torsion, particularly when the cutting edges of the scoops are acted upon by different forces opposing the closing pressure or when stones or other objects are clamped between the cutting edges and cause the latter to be subjected to unbalanced loads.

A two-sided grab bucket which is of the type described first hereinbefore and has been disclosed in U.S. Pat. No. 4,405,167 is provided with means which increase the torsional stiffness of the grab bucket without substantially increasing its weight. To that end a tube is welded to the inside surfaces of the side walls of each scoop near its upper edge and is adapted to take up the torsional forces which act on the side walls of the scoops and tend to distort the same. But the stiffening of the scoops with tubes which are welded to the side walls of the scoops gives rise to difficulties regarding the pivotal mounting of the scoops because the tube should also be used for the pivotal mounting of the scoops so that there will be no need for additional pivots or stiffeners, and because the bearings should not protrude beyond the side walls of the scoops, which side walls determine the width of the grab bucket. Such protruding bearing elements might be damaged and constitute obstructions during the operation of the grab bucket. In the two-sided grab bucket disclosed in U.S. Pat. No. 4,405,167 the torsion-resisting tubes which connect the side walls of the scoops are provided near their ends with radial slots, which extend around part of the periphery of the tubes, and the legs of the scoop carrier extend through said slots and are formed with bearing bores so that the legs can be pivoted in the tubes and the side walls of the scoops by means of pivot pins inserted into the tubes. In the known two-sided grab bucket the tubes welded to the side walls of the scoops can effectively stiffen the scoops in spite of the peripheral slots in the tubes, but the mounting of the legs of the scoop carrier in the slotted portions of the torsion-resisting tubes is complicated and expensive.

SUMMARY OF THE INVENTION

It is an object of the invention to provide a two-sided grab sucket which is of the kind described first hereinabefore and which has scoops having a higher torsional strength whereas the pivotal mountings for the scoops are simplified.

This object is accomplished in accordance with the invention that the crosspiece are constituted by shafts, which are provided with annular bearing surfaces on opposite sides of the longitudinal center line of the two-sided grab bucket, said annular bearing surfaces are rotatably mounted in split bearings, the legs of the scoop carrier are provided on both sides with the inner bearing shells of the split bearings, and the outer bearing shells are screw-connected to the inner bearing shells. In the two-sided grab bucket in accordance with the invention the side walls of the scoops are welded to the end faces of the continuous shafts, each of which may be solid or tubular. Because the bearings are split, the shafts which stiffen the scoops may be mounted at their bearing surfaces in the legs of the scoop carrier by a simple assembling operation and there is no need for expensive structures and for a machining which would decrease the cross-sectional area of the shafts. In the two-sided grab bucket in accordance with the invention the end faces of the shafts can be welded to the side walls of the scoops in a simple operation, which will not affect the bearings. Because only a confined space is available, no parts should protrude from the side walls of the scoops, and an adequate strength should be ensured, only welded joints rather than disengageable joints may be adopted.

A simple and reliable connection of the bearing shells by means of screws can be effected in that the inner bearing shells are provided on the end faces of crosspieces, which are connected to the legs of the scoop carrier in T-shape, and the two outer bearing shells are connected to the crosspiece by necked-down bolts, which extend through aligned bores in the two outer bearing shells and the crosspiece.

In accordance with another desirable feature of the invention the crosspieces which are provided with the inner bearing shells are connected by means of screws to the legs of the scoop carrier. If the crosspieces, which constitute the intermediate members of the bearing assembly, are detachably connected to the legs, said legs can be made economically and with a high precision by small machine tools. The shafts used to stiffen and pivotally mount the scoops of the two-sided grab bucket can also be made with high accuracy as simple parts on a lathe before they are welded.

In accordance with a further preferred feature of the invention the bearing surfaces of the shafts and the bearing shells are formed with annular or semi-annular grooves, which in the assembled grab bucket combine to form annular passages and contain split retaining rings for axially fixing the shafts. When the grab bucket is canted and subjected to forces acting in the axial direction of the shaft, said forces will be taken up by the retaining rings. Retaining rings are suitably provided adjacent to each end of each bearing surface, so that two retaining rings are provided per bearing.

In accordance with a further preferred feature of the invention the shafts and bearing shells are provided with additional grooves on both sides of the bearing surfaces and O-ring seals are contained in said additional grooves. By such seal rings, the pivotal mountings can be sealed against an ingress of dust so that self-lubricating bearings may be used and the servicing requirements will be decreased.

In accordance with a further preferred features, alloy steel strips are provided on the bearing surfaces and have angled end portions retained in longitudinal grooves of the shafts. The alloy steel strips are suitably arranged between the retaining rings so that the latter hold the alloy steel strips also against an axial displacement.

Two-part plastic bearings or integral plastic strips may be applied to the bearing surfaces consisting of thin, wear-resistant stainless steel, and the length of said plastic bearings or plastic strips may be so selected that the plastic bearings or plastic strips will be held in the bearing shells.

The moment which is due to the compressive force and the reaction force acting on the lever arm that is defined by the distance between the cutting edge and the bearing will cause high bending moments to be exerted on the shafts used to stiffen and pivotally mount the scoops. Said bending moments are much higher than the bending moments which result from the compressive and tensile forces that are exerted when the grab bucket is supported on or torn out of the ground. In accordance with a further preferred feature of the invention the bending moments acting on the shafts are reduced in that the shafts are provided with additional bearing surfaces, which are movably mounted in split bearings of links, which at the ends of their inner portion are provided with bearing shells, which are connected by screws to the outer bearing shells. The provisions of links for pivotally mounting the shafts will be particularly suitable if a plurality of hydraulic piston-cylinder units are provided for exerting strong closing forces.

The economy of the excavating or dredging operations can be increased if the grab buckets can be changed in width without a need for a separate grab bucket for each width. For this purpose a further preferred feature of the invention resides in that each of the crosspiece constituted by the shafts is split between the means for mounting the shaft on the legs of the scoop bucket and the welded joints connecting said shaft to the side walls of the scoop and the intermediate shaft section is connected by couplings to the shaft and sections welded to the side walls of the scoops. When the scoops of such grab bucket are to be replaced in order to change the width of the grab bucket, it will be sufficient to separate the couplings and to reconnect them when scoops of the desired width have been mounted.

The shaft end sections extending between the couplings and the side walls of the scoop can suitably be interconnected by links provided with split bearings. Such links will reduce the bending moments acting on the shafts and will hold the scoops together when they have been detached so that their assembly will be greatly facilitated.

The couplings may consist of plates, which are connected to the shaft ends and constitute a wedge-shaped array and are formed with longitudinally extending grooves having a tooth-shaped cross-section, and the shaft end sections, the intermediate shaft section and the plates may be formed with aligned bores, which receive a necked-down bolt. Torque will be transmitted by the interlocking coupling plate whereas the neck-down bolt will ensure that the joint has an adequate strength.

The bores suitably contain rings of hardened steel and the necked-down bolt is suitably provided with a mandrel, which is centered in said rings.

To facilitate the sliding movement of the necked-down bolt, the rings associated with each coupling are suitably different in diameter and the mandrel is stepped to match said diameters.

BRIEF DESCRIPTION OF THE DRAWINGS

FIG. 4 is a diagrammatic side elevation showing a detachable scoop provided with a center piece of the grab bucket before the latter is assembled.

FIG. 5 is a top plan view showing the coupling plate of the intermediate shaft section.

FIG. 6 is a top plan view showing the interconnection coupling elements.

DETAILED DESCRIPTION OF THE PREFERRED EMBODIMENTS

Illustrative embodiments of the invention will now be explained more in detail with reference to the drawings.

Figure 1:
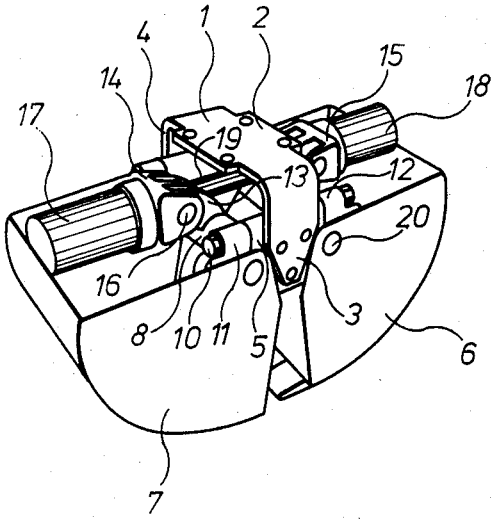
FIG. 1 is a perspective view showing a two-sided grab bucket.

The two-sided grab bucket shown in FIG. 1 comprises a U-shaped scoop carrier 1, which at its crossbeam 2 is connected in known manner to a bucket arm by means of a rotary hydraulic motor, not shown. Crossbeams 5 are bolted to the inside surfaces of the legs 3, 4 and formed with the inner parts of the bearings for the shafts 8, 9, which stiffen the scoops 6, 7. The shells 11, 12 of said bearings are fixed to the crossbeams 5 by means of necked-down bolts 10.

Two slightly curved actuating levers 13 are welded to each of the shafts 8, 9 and at their free ends are pivoted by means of the pins 16 to the double-forked head pieces 14, 15 of the cylinders 17, 18. The pistons disposed in the cylinders 17, 18 are interconnected by a transversely extending, common piston rod 19, which is guided in bores of the head pieces 14, 15.

Each side wall of the scoops 6, 7 is provided at its top inner corner with a bore 20, which is smaller in diameter than the shafts 8, 9. At the inner edges of the bores 20, the side walls are welded to the end faces of the shafts 8, 9, which close the bores on the inside.

Figure 3:
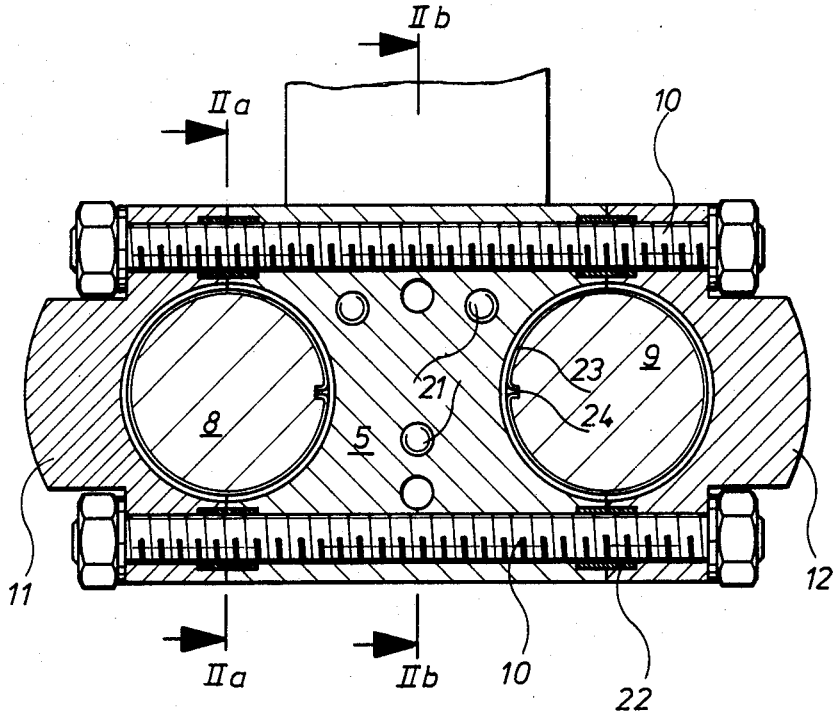
FIG. 3 is a transverse sectional view taken on line III—III in FIG. 2 and showing the mounting of the scoops.

The crosspieces 5 which constitute the intermediate parts of the bearing assemblies are connected by screws 21 to the legs 3, 4 of the scoop carrier. As is apparent from FIG. 3, the crosspiece 5 and the bearing shells 11, 12 are formed with aligned bores, which contain necked-down bolts 10. In order to center the bearing shells 11, 12 on the crosspiece 5, which constitutes the intermediate bearing element, the bores are formed adjacent to the butt joints with enlarged portions, which contain centering bushings 22.

Adjacent to the bearings the shafts 8, 9 are provided with bearing surfaces, which are covered each by a thin strip 23 of wear-resisting stainless steel. As is apparent from FIG. 3 said strip has angled end portions, which are held in a longitudinal groove 24 formed in each of the shafts 8, 9. On opposite sides of each bearing surface, the shafts 8, 9 are formed with annular grooves, which contain a split retaining ring 25. Additional grooves 46 are provided on opposite sides of retaining rings 25 with "O" ring seals 47 contained therein. The stainless steel strip 23 is held between said retaining rings 25. The two bearing shells of the crosspiece 5 and the bearing shells 11, 12 are formed with corresponding annular grooves, which in the assembled grab bucket receive the retaining rings 25 as is shown in FIG. 2.

Each of the shafts 8, 9 has an intermediate section, which is formed with a recess that is adapted to receive part of the piston rod 19 as the grab bucket is closed so that the grab bucket may be compact and small in height.

An embodiment of the grab bucket which can be provided with scoops differing in width will now be described with reference to FIGS. 4 to 7.

Figure 2:
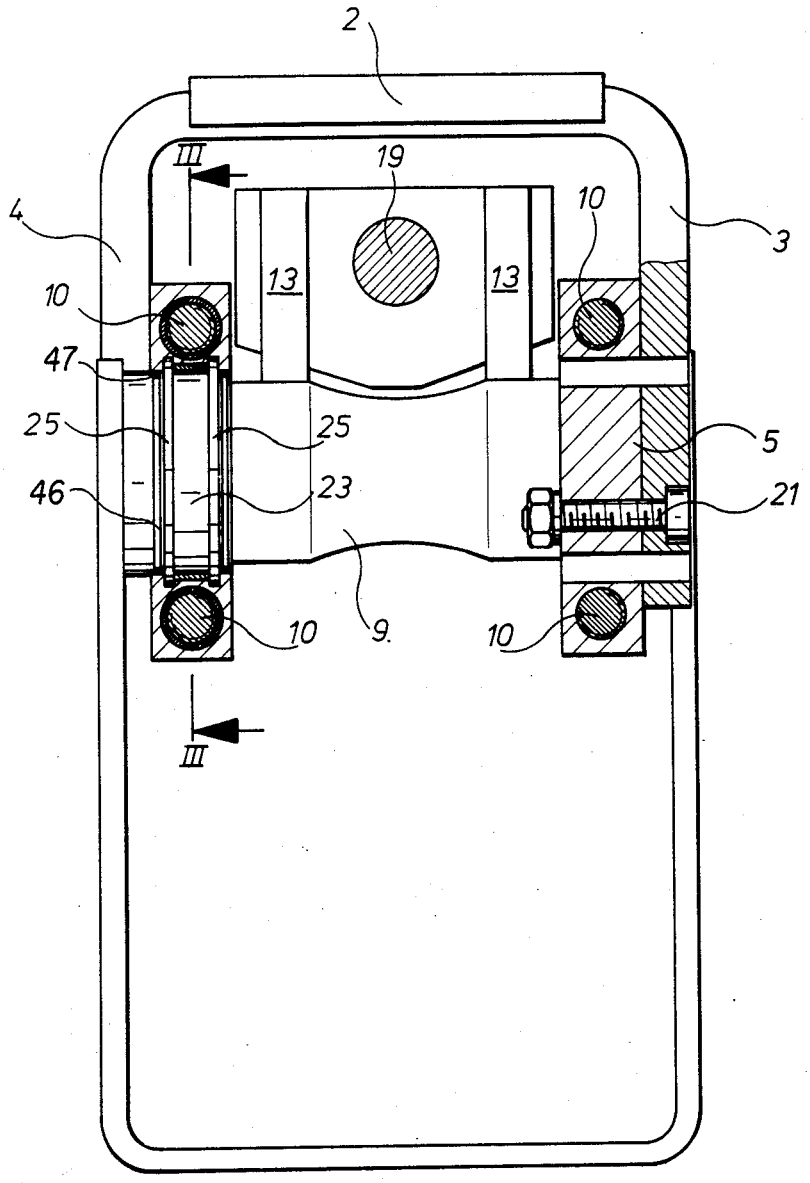
FIG. 2 is a transverse sectional view taken on lines II*a*—II*a* and II*b*—II*b* in FIG. 3.

The upper portion of FIG. 4 corresponds to the showing in FIG. 2 with the difference that the intermediate shaft section 28 is connected at its ends to the coupling plates 29, 30, which constitute a V-shaped array, rather than to the side walls of the scoops. The crosspiece 5 which constitute the intermediate bearing elements are screw-connected to the legs 3, 4 of the scoop carrier by means which are shown only in FIGS. 1 to 3. In the showing of FIG. 4, the bearing shells on the crosspieces 5 have been omitted.

The shaft end sections 33, 34 are adapted to be connected to the intermediate shaft section 28 by means of the coupling plates 29, 30 and the coupling plates 31, 32, which also constitute a V-shaped array. The coupling plates 31, 32 are welded to the inwardly protruding free ends of the shaft end sections 33, 34. The coupling plates 29, 30 and 31, 32 have the same inclination and are spaced such a distance apart that the coupling plates 29, 30 mounted on the intermediate shaft section 28 can be inserted between the coupling plates 31, 32 so that the intermediate shaft section 28 is aligned with the shaft end sections 33, 34. As is apparent from FIG. 5 the coupling plates 29 to 32 are formed with longitudinally extending grooves, which constitute mutually complementary teeth, as is shown in FIG. 6.

Figure 7:
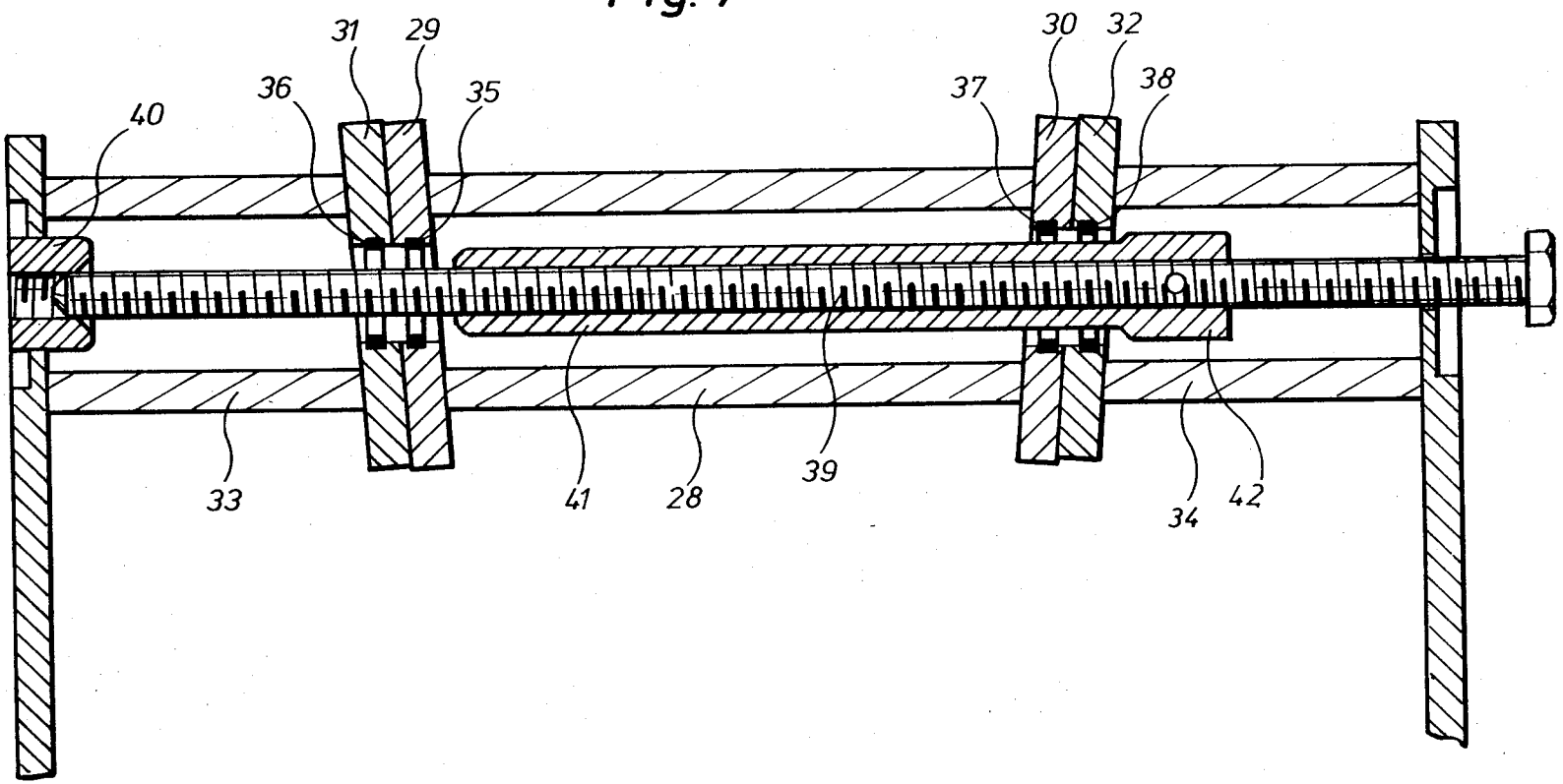
FIG. 7 is a longitudinal sectional view showing a shaft during the tightening of the coupling joint.

As is apparent from FIG. 7, the intermediate shaft section 28 and the shaft end sections 33, 34 are tubular. Adjacent to the coupling plates 31, 32 the bores of the tubular shaft sections contain rings of hardened steel 35, 36 and 37, 38. The coupling plates 31 to 32 are forced against each other by the necked-down bolt 39, which is introduced into a bore formed in the side wall which is on the right in FIG. 7. The bolt 39 is screwed into a nut 40, which is welded to the left-hand scoop. A bushing 41 having stepped diameters is secured to the necked-down bolt 39. That portion of the bushing which leads in the direction of insertion is smaller in diameter and matches the diameter of the centering rings 35, 36. The centering rings 37, 38 are larger in diameter and match the enlarged portion 42 of the bushing 41.

As is apparent from FIG. 4, the shaft end sections 33, 34 are interconnected by links, which are provided with split bearings. Only the inner portions 43, 44 of said links are shown in FIG. 4.

In accordance with the different width of the scoops which can be used in a given two-sided grab bucket, the shaft end sections 33, 34 differ in length.

I claim:

1. A two sided grab bucket comprising a U-shaped scoop carrier including an upper cross arm and depending side legs, a pair of scoops each including a pair of opposite side walls and a crosspiece extending between and affixed to a respective pair of said scoop side walls said crosspieces being pivoted to said scoop carrier legs for rotation about transversely spaced axes, an actuating lever secured to each of said crosspieces and a transversely extending piston-cylinder unit pivoted at opposite ends to and intercoupling the free ends of said levers, said grab bucket being characterized in that said crosspieces are defined by shafts having annular bearing surfaces on opposite sides of the plane intermediate said scoops and in comprising a pair of split bearings rotatably engaging each of said bearing surfaces, inner bearing shells secured to opposite sides of each of said scoop carrier legs and outer bearing shells separably secured to each of said inner bearing shells, each of said split bearings being mounted in a respective pair of said inner and outer bearing shells.

2. A two sided grab bucket according to claim 1, characterized in that said scoop carrier legs terminate in transverse crosspieces having opposite end faces and the inner bearing shells are provided on said end faces, and two of said outer bearing shells are connected to each respective crosspiece by bolts, which extend through aligned bores in the two outer bearing shells and the transverse crosspiece.

3. A two-sided grab bucket according to claim 1, characterized in that the crosspieces which are provided with the inner bearing shells are connected by screws to the legs of the scoop carrier.

4. A two-sided grab bucket according to claim 1, characterized in that the bearing surfaces of the shafts and the bearing shells are formed with annular or semi-annular grooves, which in the assembled grab bucket combine to form annular passages and contain split retaining rings for axially fixing the shafts.

5. A two-sided grab bucket according to claim 1, characterized in that the shafts and bearing shells are provided with grooves on both sides of the bearing surfaces and O-ring seals are contained in said grooves.

6. A two-sided grab bucket according to claim 1, characterized in that alloy steel strips are provided on the bearing surfaces and have angled end portions retained in longitudinal grooves of the shafts.

7. A two-sided grab bucket according to claim 1, characterized in that the shafts are provided with additional bearing surfaces, which are movably mounted in split bearings of links, which at their ends are provided with inner bearing shells, which are connected by screws to outer bearing shells.

8. A two-sided grab bucket according to claim 1, characterized in that each of the crosspieces constituted by a shaft is split between an intermediate shaft section for mounting the shaft on the legs of the scoop carrier and opposite end shaft sections connected to the side walls of the scoop, the intermediate shaft section being connected by couplings to the end shaft sections.

9. A two-sided grab bucket according to claim 8, characterized in that the shaft end sections extending between the couplings and the side walls of the scoops are interconnected by links provided with split bearings.

10. A two-sided grab bucket according to claim 8, characterized in that the couplings consist of plates, which are connected to the shaft ends and constitute a wedge-shaped array and are formed with longitudinally extending grooves having a tooth-shaped cross-section, and the shaft end sections, the intermediate shaft section and the plates are formed with aligned bores, which receive a bolt.

11. A two-sided grab bucket according to claim 10, characterized in that the bores in the plates contain rings of hardened steel, and the bolt is provided with a bushing which is centered in said rings.

12. A two-sided grab bucket according to claim 11, characterized in that the rings associated with each coupling are different in diameter and the bushing is stepped to match said diameters.

* * * * *